US005576743A

United States Patent [19]

Momose et al.

[11] Patent Number: 5,576,743

[45] Date of Patent: Nov. 19, 1996

[54] INK JET RECORDING APPARATUS AND METHOD OF CONTROLLING THEREOF

[75] Inventors: Kaoru Momose; Munehide Kanaya; Masahiko Yoshida; Hikonosuke Uwai, all of Nagano, Japan

[73] Assignee: Seiko Epson Corporation, Tokyo, Japan

[21] Appl. No.: 203,312

[22] Filed: Mar. 1, 1994

[30] Foreign Application Priority Data

Mar. 1, 1993 [JP] Japan ..... 5-040054
Feb. 21, 1994 [JP] Japan ..... 6-046363

[51] Int. Cl.[6] ..... B41J 2/045

[52] U.S. Cl. ..... 347/11

[58] Field of Search ..... 347/9–11,68,70,72,94; 310/317; B41J 2/045, 2/055

[56] References Cited

U.S. PATENT DOCUMENTS 4,509,059 4/1985 Howkins ..... 347/14
4,523,200 6/1985 Howkins ..... 347/11
5,359,350 10/1994 Nakano et al. ..... 347/10

FOREIGN PATENT DOCUMENTS 0548984 12/1992 European Pat. Off. .
580154 1/1994 European Pat. Off. ..... B41J 2/045
3508556 11/1985 Germany .

OTHER PUBLICATIONS

Patent Abstracts of Japan, vol. 8, No. 238 (M–335), Oct. 31, 1984 (JP–A–59 118 466, Jul. 9, 1984).
Patent Abstracts of Japan, vol. 14, No. 83 (M–936), Feb. 16, 1990 (JP–A–01 297 256, Nov. 30, 1989).
Patent Abstracts of Japan, vol. 14, No. 420 (M–1023), Sep. 11, 1990 (JP–A–02 165 957, Jun. 26, 1990).

*Primary Examiner*—Alrick Bobb
*Attorney, Agent, or Firm*—Sughrue, Mion, Zinn, Macpeak & Seas

[57] ABSTRACT

An ink jet recording apparatus comprising: an ink jet recording head for sucking an ink into a pressure chamber and jetting an ink droplet from a nozzle opening by expanding and contracting the pressure chamber by a piezoelectric vibration element; the pressure chamber being formed of a nozzle plate and a vibration plate; and a signal generating device for generating signals. The signals includes a first signal for contracting the piezoelectric vibration element at a predetermined speed to suck the ink into the pressure chamber, a second signal for starting an extension process of the piezoelectric vibration element to splash the ink droplet from the nozzle opening by contracting the pressure chamber, a third signal for interrupting the extension process of the piezoelectric vibration element at least once while the extension process is still being performed and a fourth signal for resuming the extension process of the piezoelectric vibration element again after a predetermined period has elapsed.

10 Claims, 15 Drawing Sheets

| TEMPE-RATURE | A1 | A2 | A3 | .... | An |
|---|---|---|---|---|---|
| Tc | B1 | B2 | B3 | .... | Bn |
| Td1 | C1 | C2 | C3 | .... | CN |

INK JET RECORDING APPARATUS AND METHOD OF CONTROLLING THEREOF

BACKGROUND OF THE INVENTION

The invention relates to an ink jet printer that records images and characters on a recording sheet by jetting ink droplets from nozzle openings by extension and contraction of piezoelectric vibration elements. More particularly, the invention is directed to an art for driving the piezoelectric vibration elements of an ink jet recording head.

There are two types in the jet printer. A piezoelectric vibration type is designed to jet ink droplets by expanding and contracting pressure chambers by piezoelectric vibration elements, and a thermal type is designed to arrange heating means within pressure chambers and jet an ink by taking advantage of pressure produced by instantly gasifying the ink while supplying electric energy to the heating means.

Particularly, the recording head of the former type that produces ink droplets by extension and contraction of the piezoelectric vibration elements repeats at a predetermined cycle the process of: contracting the piezoelectric vibration elements so as to expand the pressure chambers before jetting the ink, thereby introducing the ink into the pressure chambers; extending the piezoelectric vibration elements so as to correspond to a print signal inputted after a predetermined time elapses thereafter; and jetting ink droplets from nozzle openings by the pressure thereby produced.

Since dots are formed on a recording sheet by splashing ink droplets a predetermined distance between the head and the sheet, the print quality is affected by the ink droplet splashing speed with the ink droplets being affected by the gravitational force, the speed of movement of the recording head, and the like. To improve the print quality, the ink droplet splashing speed must be increased as much as possible.

Since the ink droplet splashing speed depends on the piezoelectric vibration element extension speed which is used for the recording head, the speed of varying a drive signal voltage must be increased as much as possible.

However, the piezoelectric vibration element is subjected to residual vibration at the self resonance frequency after an ink droplet has been jetted once the extension speed thereof exceeds a certain value. Thus, a so-called "satellite" with small ink droplets is produced after the ink droplet has been jetted, from which arises a problem of further impairment of the print quality.

SUMMARY OF THE INVENTION

The invention has been made in view of the above circumstances. Accordingly, the object of the invention is to provide an ink jet recording apparatus capable of reducing residual vibration of a piezoelectric vibration element after an ink droplet has been jetted to a smallest possible extent and improving the print quality by increasing the ink droplet splashing speed.

To achieve the above object, the present invention provides an ink jet recording apparatus that includes: an ink jet recording head for sucking an ink into a pressure chamber and jetting an ink droplet from a nozzle opening by expanding and contracting the pressure chamber by a piezoelectric vibration element, the pressure chamber comprising a nozzle plate and a vibration plate; and a signal generating means for generating a first signal for contracting the piezoelectric vibration element at a predetermined speed to suck the ink into the pressure chamber, a second signal for starting an extension process of the piezoelectric vibration element to splash the ink droplet from the nozzle opening by contracting the pressure chamber, a third signal for interrupting the extension process of the piezoelectric vibration element at least once while the extension process is still being performed; and a fourth signal for resuming the extension process of the piezoelectric vibration element again after a predetermined time has elapsed.

When the piezoelectric vibration element in a contracted state is extended, the pressure chamber is being contracted, so that the ink within the pressure chamber is given sufficient kinetic energy in the form of pressure, causing a column of ink to grow larger. When the application of an operating voltage is temporarily stopped after a predetermined time has elapsed, the piezoelectric vibration element starts residual vibration defined by the self resonance frequency. By optimizing not only the temporary stop timing but also an operating voltage application timing for the rest of the extension process after the temporary stop, the length of the piezoelectric vibration element can be brought back to the natural length with few residual vibration. Thus, production of satellite and the like can be prevented.

It is optimal to set the predetermined time so that an extension of the piezoelectric vibration element becomes exactly equal to the natural length of the piezoelectric vibration element, such extension being brought about by the piezoelectric vibration element overshooting immediately after the application of the operating voltage is temporarily stopped after the piezoelectric vibration element has started extending at an extension speed and the predetermined time has then elapsed. In other words, the piezoelectric vibration element extending speed and the temporary stop timing are set so that the extension due to the overshoot of the piezoelectric vibration element stops at such a timing that the length of the piezoelectric vibration element exactly reaches the natural length.

On the other hand, the timing for resuming the application of the operating voltage of the temporarily stopped piezoelectric vibration element may be optimized by setting to such an instance that the extension due to the overshoot of the piezoelectric vibration element has been ended and the piezoelectric vibration element is thereby about to start contracting. The reason therefor is that since the contraction process after the overshoot cancels out the extension process after the resumption of the application of the operating voltage to the piezoelectric vibration element, there is no apparent displacement of the piezoelectric vibration element, thereby allowing the piezoelectric vibration element to be settled to the natural length.

In contrast thereto, if this timing is set to too small a value, the piezoelectric vibration element extension process to be caused by the application of the operating voltage starts while the extension due to the overshoot of the piezoelectric vibration element is still taking place, thus causing residual vibration. Further, if this timing is set to too large a value, the piezoelectric vibration element contraction process subsequent to the extension process starts, thus again causing residual vibration.

DETAILED DESCRIPTION OF THE PREFERRED EMBODIMENTS

Details of the invention will now be described with reference to embodiments shown in the accompanying drawings.

Figure 1:
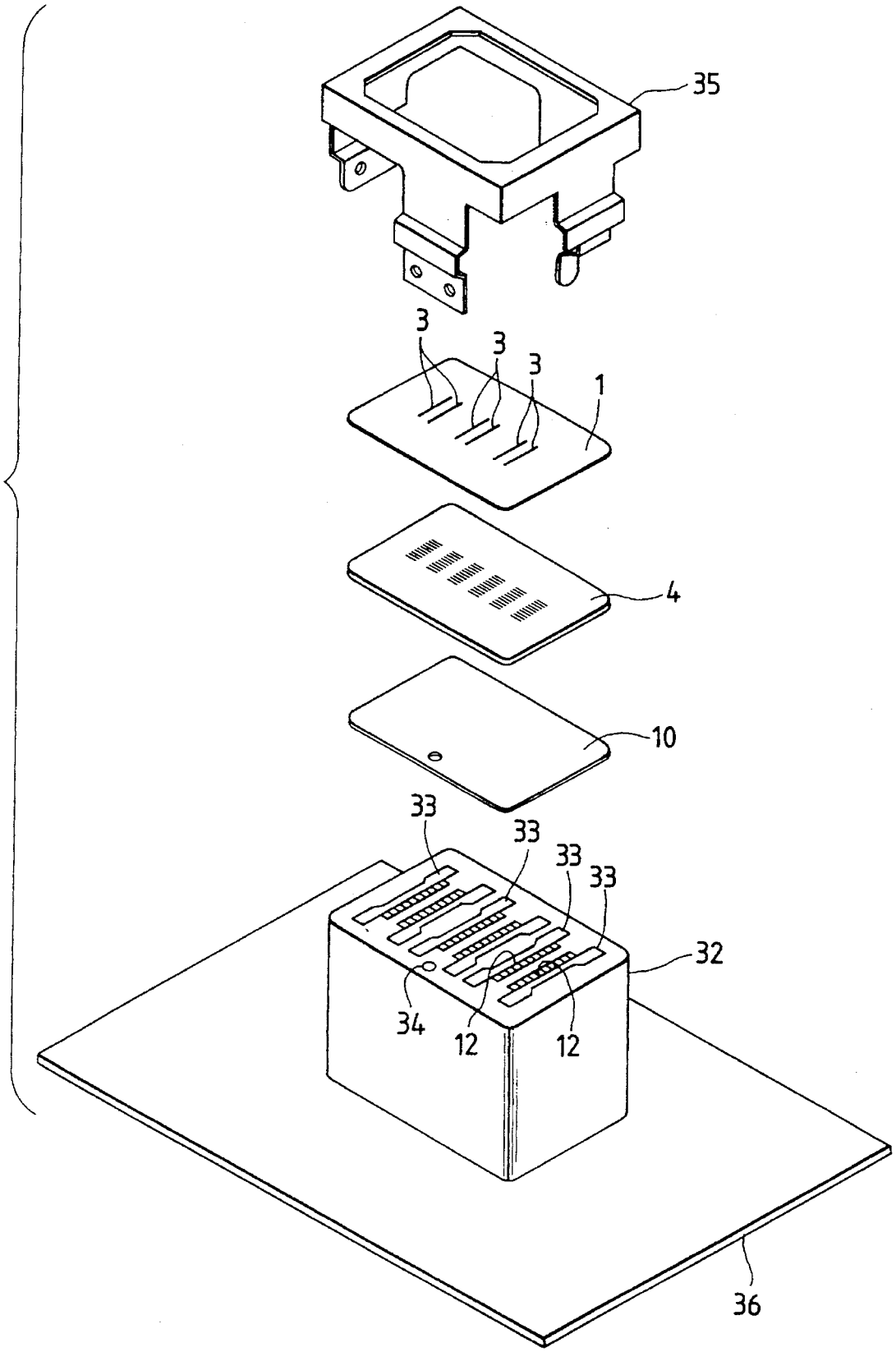
FIG. 1 is a perspective view showing an assembly of an ink jet recording head according to the present invention.

FIG. 1 is an ink jet recording head according to the present invention. In FIG. 1, reference numeral 1 designates a nozzle plate on which nozzle opening arrays 3, each having nozzle openings 2 (FIG. 2) formed thereon, are arranged so that a predetermined pitch of, e.g., 180 DPI can be achieved.

Figure 2A:
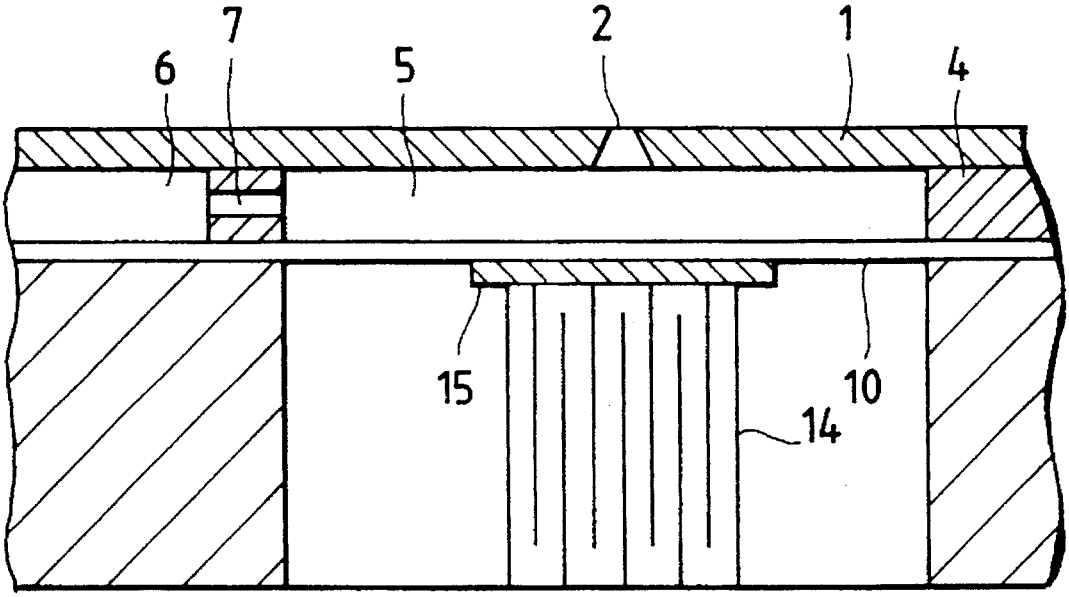
FIGS. 2(*a*) and (*b*) are sectional views showing the recording head with a piezoelectric vibration element being contracted and extended.
Figure 2B:
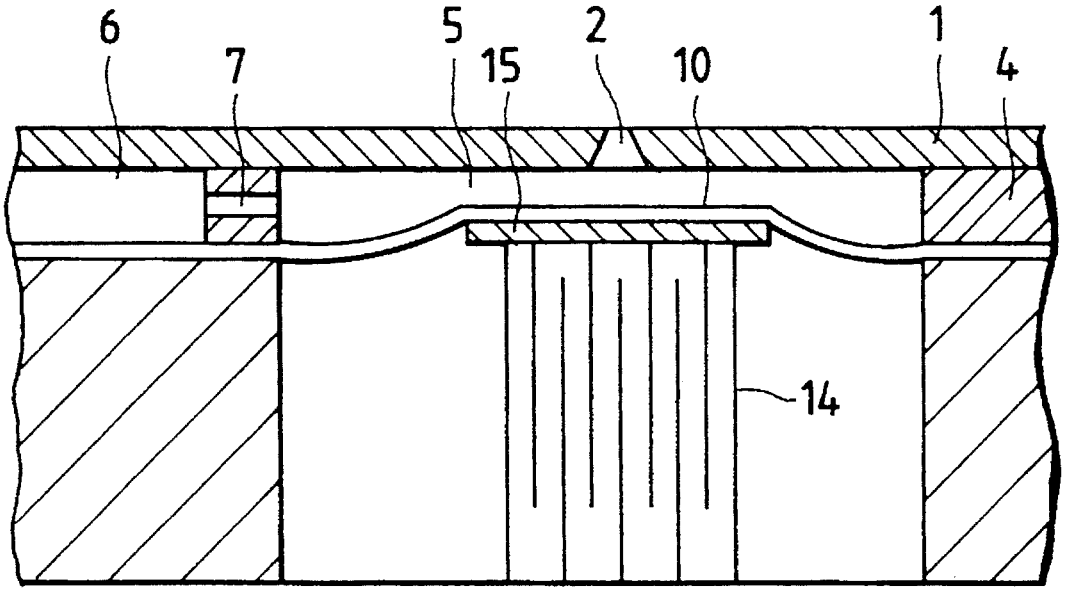

Reference numeral 4 designates a spacer interposed between a vibration plate 10 (described later) and the nozzle plate 1. As shown in FIG. 2, through holes are formed to define pressure chambers 5, reservoirs 6, and ink supply ports 7 in such a manner as to correspond to the nozzle openings 2 and the ink supply ports 7 connecting the pressure chambers 5 to the reservoirs 6.

Reference numeral 10 designates the vibration plate, which forms pressure chambers 5 while confronting the nozzle plate 1 through the spacer 4. As shown in FIG. 2, island portions 15 are formed on the vibration plate 10. Each island portion 15 has such a rigidity as to transmit displacement resulting from the island portion abutting against an end of a piezoelectric vibration element 14 (described later) of a piezoelectric vibration unit 12 to a largest possible area. As a result of the construction, the pressure chamber 5 can be contracted and expanded efficiently in response to contraction and extension of the piezoelectric vibration element 14.

Figure 3:
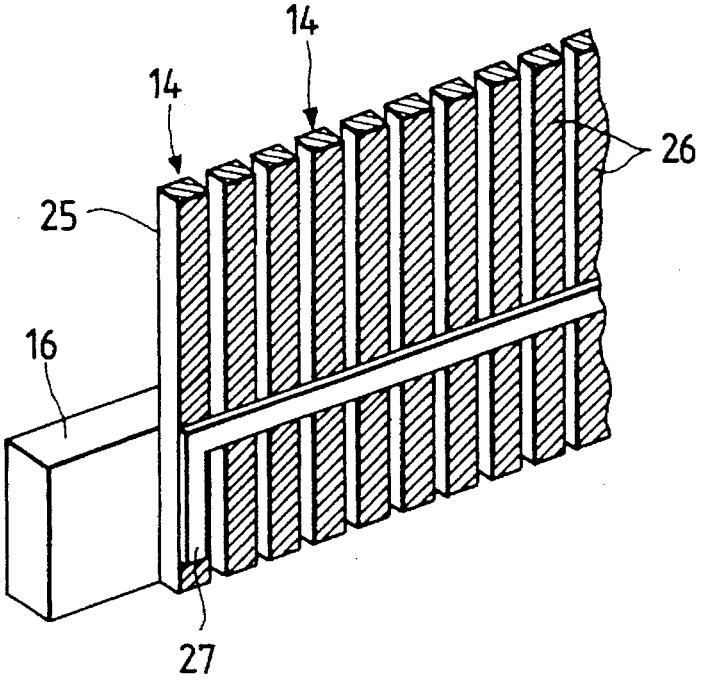
FIG. 3 is a perspective view showing a piezoelectric vibration element unit according to the present invention.

These piezoelectric vibration units 12, as shown in FIG. 3, include the piezoelectric vibration elements 14 which are secured to a fixing substrate 16 at a predetermined pitch so that the free ends of the vibration elements can vibrate in a vertical vibration mode, respectively.

Figure 4:
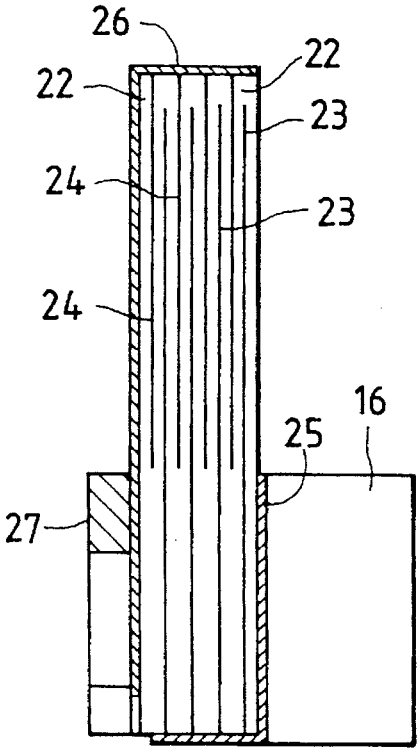
FIG. 4 is a sectional view showing a piezoelectric vibration element according to the present invention.

Each piezoelectric vibration element 14 is formed in such a manner that a piezoelectric vibration material 22, a drive electrode 23, and a common electrode 24 are laminated one upon another in sandwich form as shown in FIG. 4. The drive electrodes 23 are exposed to the fixed end of the piezoelectric vibration element 14 and connected in parallel to an outer drive electrode 25 formed by, e.g., vapor deposition. The common electrodes 24 are exposed to the free end of the piezoelectric vibration element 14 and are connected in parallel to an outer common electrode 26. More than one vibration element is connected in parallel to the outer common electrode 26 through a conductive member 27.

Returning to FIG. 1, reference numeral 32 designates a base stand, in which unit accommodating holes 33 and an ink supply port 34 are arranged. The unit accommodating holes serve to accommodate the vibration element units 12 so that the free ends of the piezoelectric vibration elements 14 are exposed therefrom, and the ink supply port 34 serves to supply ink from an ink tank to the reservoirs 6. The vibration plate 10, the spacer 4, the nozzle plate 1 are positioned on the surface of the base stand 32, fixed by a frame body 35 that serves also as an electrostatic shield, and assembled to form a recording head body. Reference numeral 36 designates a board on which to mount a carriage.

Figure 5:
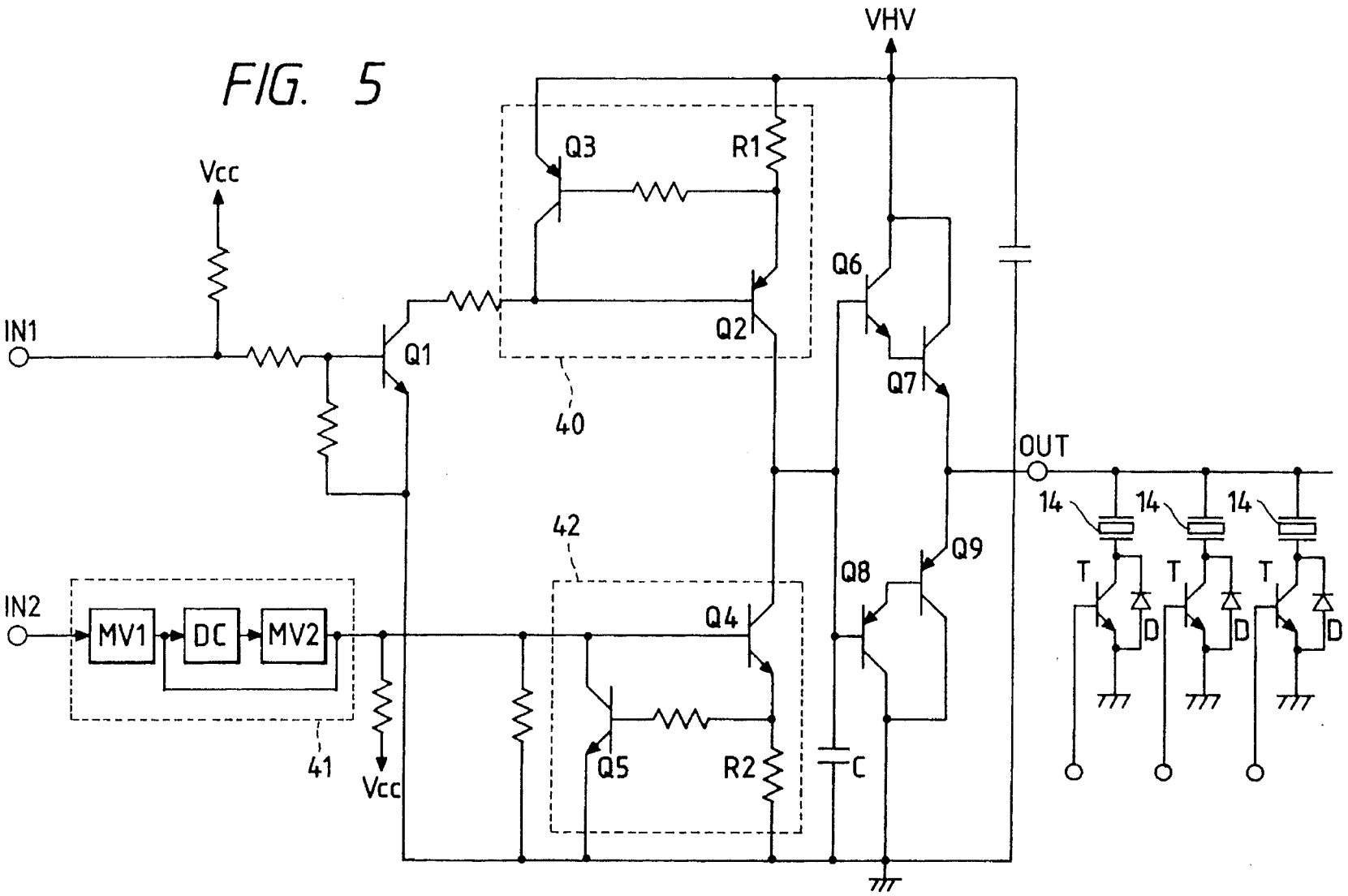
FIG. 5 is a circuit diagram showing a drive circuit of the ink jet recording head of the invention.
Figure 6:
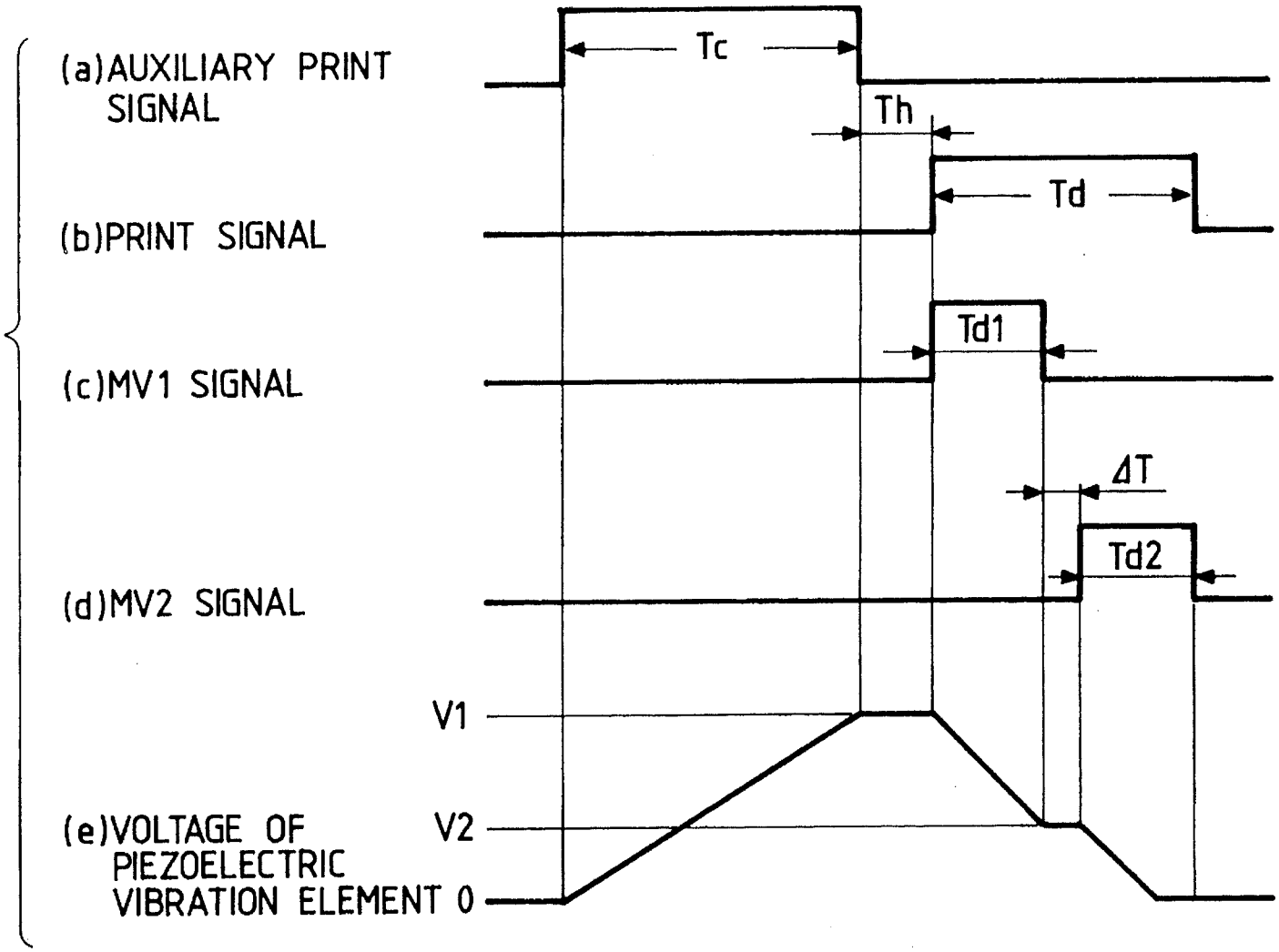
FIG. 6 is a waveform diagram showing an operation of the drive circuit.

FIG. 5 shows a drive circuit according to the present invention for driving the recording head. In FIG. 5, reference character IN1 designates an input terminal for receiving an auxiliary print signal that contracts the piezoelectric vibration element 14, and a signal which has such a waveform as shown in (a) of FIG. 6 is inputted thereto. Reference numeral IN2 designates an input terminal for receiving a print signal that extends the contracted piezoelectric vibration element 14, and a signal which has such a waveform as shown in (b) of FIG. 6 is inputted thereto. A first constant current circuit 40 is connected to the input terminal IN1 through a level shift transistor Q1. The constant current circuit 40 includes transistors Q2, Q3 and a resistor R1, and is designed to charge a capacitor C with a predetermined current.

Reference numeral 41 designates an extension control circuit and includes first and second one-shot multi-vibrators MV1, MV2 and a delay circuit DC. The first one-shot multi-vibrator MV1 operates upon input of the print signal and outputs a signal whose pulse width is Td1. The delay circuit DC operates upon fall of the signal from the first one-shot multi-vibrator MV1 and outputs a signal after a predetermined stop period $\Delta T$. The second one-shot multi-vibrator MV2 outputs a signal whose pulse width is Td2 upon receipt of the signal from the delay circuit DC. A second constant current circuit 42 is connected to the output terminal of the extension control circuit 41.

The second constant current circuit 42 includes transistors Q4, Q5 and a resistor R2, and is designed to discharge the capacitor C with a predetermined current for a period during which the signals Td1, Td2 are being outputted from the extension control circuit 41.

The terminals of the capacitor C are connected to an output terminal OUT through a current amplifying circuit in which transistors Q6, Q7 and transistors Q8, Q9 are darlington circuits.

All the piezoelectric vibration elements 14 for the recording head are connected to the output terminal OUT through transistors T that are turned on by the print signal.

Accordingly, when the auxiliary print signal is applied, the capacitor C is charged with the predetermined current. When some of the transistors T which are connected to the piezoelectric vibration elements of nozzles are selected to form dots and are turned on by a dot forming signal or the like under this condition, the piezoelectric vibration elements 14 which are selected are charged through the transistors T. Upon input of the print signal, the capacitor C is discharged, and as a result, the charges stored in the piezoelectric vibration elements 14 which are selected are discharged through diodes D.

The operation of the thus constructed drive circuit will be described in more detail with reference to a waveform diagram shown in FIG. 6.

Upon input of an auxiliary print signal (a) shown in FIG. 6 to the terminal IN1, the transistor Q1 is turned on by the rising edge of the signal (a), which then turns on the transistor Q2 of the first constant current circuit 40, causing current to flow to the capacitor C connected to the transistor Q2 through the resistor R1.

The terminal voltage of resistor R1 is set to a base-emitter voltage of the transistor Q3, and the base-emitter voltage remains constant as long as the transistor Q3 is turned on. Therefore, the current flowing to the capacitor C is maintained at a constant value.

As a result, the terminal voltage of the capacitor increases linearly at a predetermined gradient from 0 volt as shown in (e) of FIG. 6.

That is, assuming that the rising gradient is $\tau c$ (V/sec), the resistance of the resistor R1 is r1 ($\Omega$), the capacitance of the capacitor C is c1 (F), and the base-emitter voltage of the transistor Q3 is VBE3, then $$\tau c=(VBE3/(r1\times c1).$$

Hence, by adjusting the capacitance c1 of the capacitor C or the resistance r1 of the resistor R1, the rising speed of the charging voltage, i.e., the contraction speed of the piezoelectric vibration elements 14 can be set to an arbitrary value.

The terminal voltage of the capacitor C is amplified by the transistors Q6, Q7 and applied to each piezoelectric vibration element 14 from the output terminal OUT, so that only desired piezoelectric vibration elements 14 are charged at the gradient $\tau c$ through transistors T that are selectively turned on by the dot forming signal or the like.

Since the piezoelectric vibration element 14 gets contracted at the rising gradient $\tau c$, the corresponding pressure chamber 5 expands to allow the ink to flow into the pressure chamber 5 from the reservoir 6.

When the period defined by a pulse width Tc of the auxiliary print signal has elapsed, the transistor Q1 is turned off, thereby stopping the charging of the capacitor C. As a result, the piezoelectric vibration elements 14 which are selected hold a voltage $V1=\tau c\times Tc$, thereby maintaining the contracted state.

When a predetermined period Th has passed, the print signal is inputted to the print signal input terminal IN2 ((b) of FIG. 6). This causes the signal whose pulse width is Td1 ((c) of FIG. 6) to be outputted from the first one-shot multi-vibrator MV1 of the extension control circuit 41. Then the transistor Q4 of the second constant current circuit 42 turns on, and the charges stored in the capacitor C are discharged through the resistor R2. Since the terminal voltage of the resistor R2 is equal to a base-emitter voltage VBE5 of the transistor Q5, the current flowing through the resistor R2 is maintained constant with the second constant current circuit 42 operating in the same manner as the first constant current circuit 40.

Accordingly, the terminal voltage of the capacitor C drops linearly at a falling gradient $\tau d$.

That is, assuming that the resistance of the resistor R2 is r2, and the base-emitter voltage of the transistor Q5 is VBE5, then $$\tau d=VBE5/(r2\times c1).$$

The falling voltage, i.e. the terminal voltage of the capacitor C is outputted to the output terminal OUT through the transistors Q8, Q9 and applied to the respective piezoelectric vibration elements 14. However, since it is only the piezoelectric vibration elements 14 which are selected to form dots are charged, only those selected piezoelectric vibration elements 14 are discharged at the falling gradient $\tau d$ through the corresponding diodes D and extended at a predetermined speed defined by such falling gradient. Since the extension of the selected piezoelectric vibration elements 14 generates a positive pressure within the corresponding pressure chambers 5 by contracting the pressure chambers 5 at the speed defined by the gradient $\tau d$ of the discharge current, columns of ink which have such kinetic energy as to be splashed in the form of ink droplets from the corresponding nozzle openings are formed (a portion depicted by the solid line in process a shown in FIGS. 7(*a*) and (*b*)).

When the period defined by the pulse width Td1 (FIG. 6 (*c*)) of the first one-shot multi-vibrator MV1 has elapsed during the piezoelectric vibration element 14 extending process, the transistor Q4 is turned off. As a result, the terminal voltage of the capacitor C is maintained at a level V2. Since the forced extension of the piezoelectric vibration element 14 is thereby interrupted, the piezoelectric vibration element 14 then starts residual vibration by the self resonance frequency centering around a displacement L1 up to this moment. First, the piezoelectric vibration element 14 starts extending by inertial force (a portion depicted by the solid line in process b in FIGS. 7(*a*) and (*b*)). Accordingly, it is necessary that the pulse width Td1 defining the extension stop timing is determined so that the inertial force-induced extension which is caused by interruption of the forced extension can be ended exactly when the length of the piezoelectric vibration element 14 reaches a natural length L2.

The delay circuit DC temporarily holds the applied voltage at V2 for the period $\Delta T$ thereafter. Upon elapse of the period $\Delta T$, the second one-shot multi-vibrator MV2 outputs the signal whose pulse width is Td2 ((d) of FIG. 6), which again turns on the transistor Q4. Therefore, the capacitor C discharges again the residual charges at the falling gradient $\tau d=VBE5/(r2\times c1)$.

Here, the period $\Delta T$ must be set to an interval from a time at which the inertial force-induced extension caused by the interruption of the forced extension of the piezoelectric vibration element 14 to a time at which the length of the piezoelectric vibration element has reached the natural length L2 and the piezoelectric vibration element is thereby about to start contracting. If ΔT is too short, the piezoelectric vibration element starts extending with the application of the operating voltage during the overshoot-induced extension thereof, thereby causing a relatively large residual vibration. If ΔT is too long, on the other hand, also it causes residual vibration since the piezoelectric vibration element has already started contracting after the extension.

Then, an extension process in which the piezoelectric vibration element 14 starts extending again from the natural length L2 at the speed defined by the gradient τd=VBE5/(r2×c1) cancels out the residual vibration-induced contraction process. As a result, the length of the piezoelectric vibration element 14 is settled at the natural length L2 with apparently few vibration (a portion depicted by the solid line in process c shown in FIGS. 7(*a*) and (*b*)).

Figure 7A:
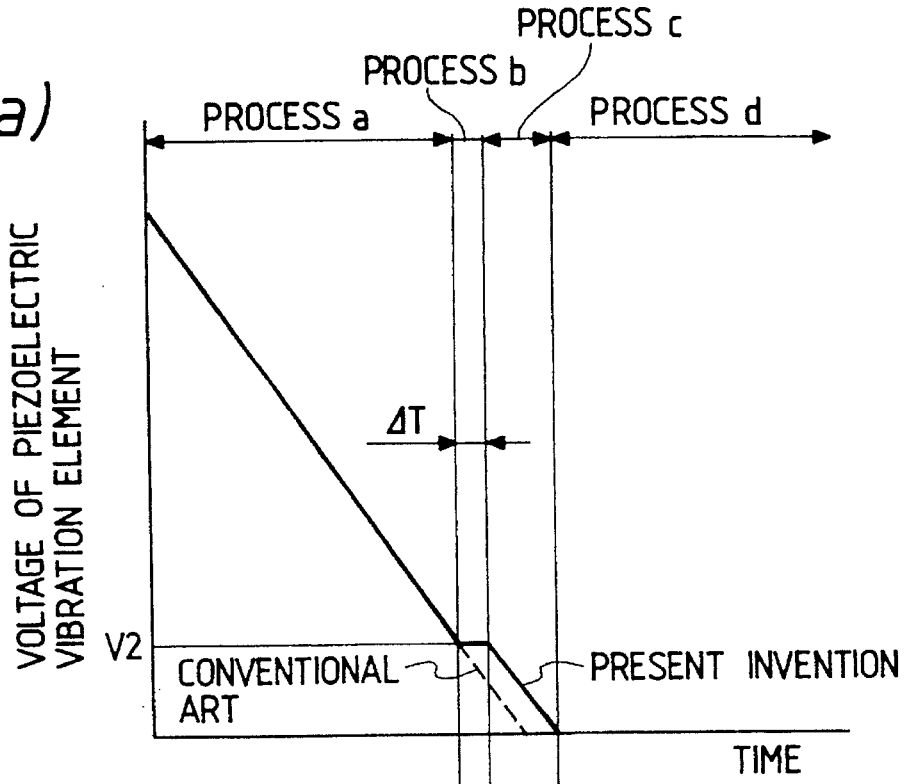
FIGS. 7 (*a*) and (*b*) are diagrams respectively showing a voltage and a displacement of the piezoelectric vibration element by the drive circuit during an ink droplet forming process.
Figure 7B:
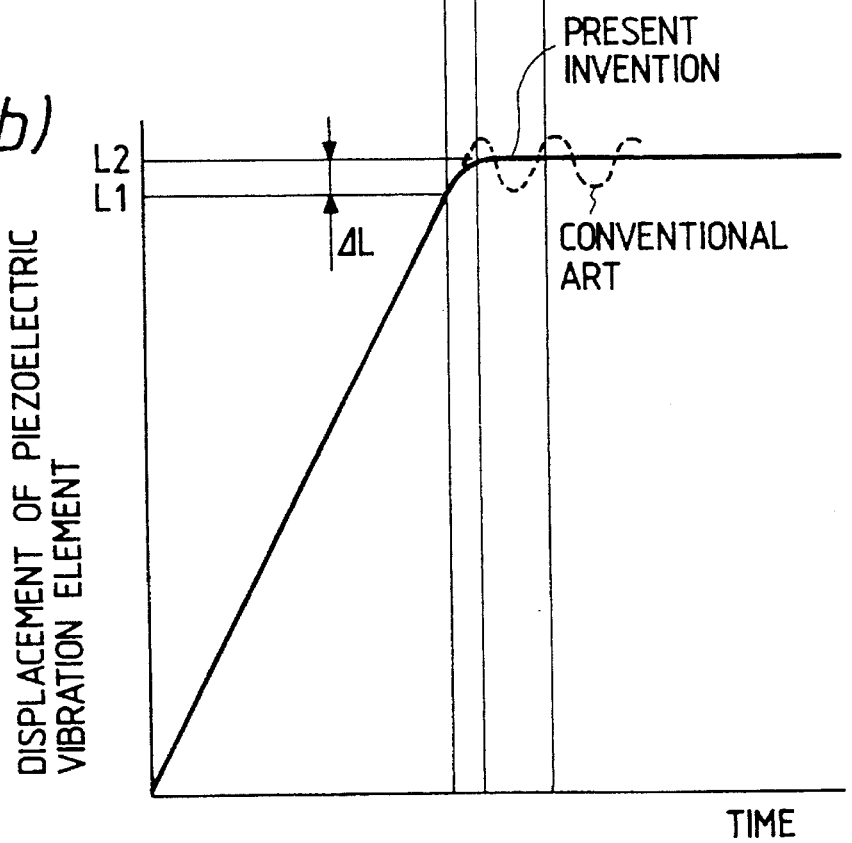

By dropping the terminal voltage of the capacitor C to zero in this way at the period of bringing the length of the piezoelectric vibration element 14 back to the natural length L2, the residual vibration can be substantially eliminated from the piezoelectric vibration element 14 (a portion depicted by the solid line in process d shown in FIGS. 7(*a*) and (*b*)).

In contrast thereto, in the conventional method in which a charged piezoelectric vibration element 14 is discharged at a stroke as indicated by a broken line in FIG. 7(*a*), the residual vibration takes place at a large amplitude centering around the natural length L2 after the end of discharge as indicated by a broken line FIG. 7(*b*). Therefore, satellite is likely to be induced by change in pressure in the pressure chamber 5.

It is found out from the above that the majority of the vibration of the piezoelectric vibration element after the ink has been jetted can be controlled by extending the piezoelectric vibration elements 14 at two stages and canceling out the residual energy at an instance at which the extension of the piezoelectric vibration element 14 is ended.

Figure 8:
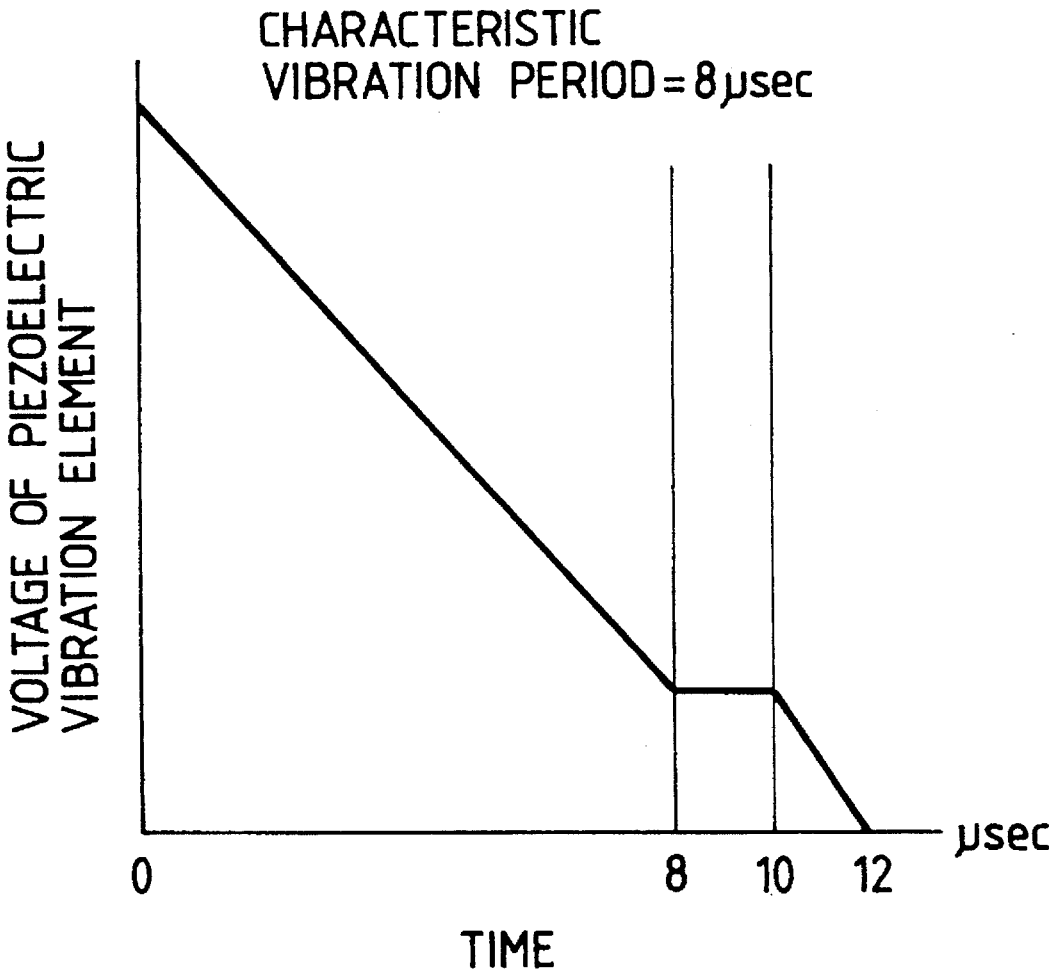
FIG. 8 is a diagram showing optimal values in voltage set to the exemplary drive circuit.

FIG. 8 shows specific values of the above-mentioned embodiment. More specifically, it is to what timing a temporary stop is set in order to minimize the residual vibration of a piezoelectric vibration element whose length is about 5 mm and whose characteristic vibration period is about 8 μsec that is exemplified. In this example, the extension speed during discharge is set to the same value in both processes a and c.

As a result, it can be said that the optimal duration of the process a up to a temporary stop is about 8 μsec, i.e., a single characteristic vibration period, and that the optimal period ΔT of the process b during which the voltage is temporarily held is 2 μsec, which is about a quarter of the characteristic vibration period.

It can also be said that the optimal duration of the subsequent process c is 2 μsec, which is about a quarter of the characteristic vibration period, as long as the discharge speed is the same in both processes a and c as in this embodiment.

However, the definitions of these periods are not simply applicable as the conditions. What is necessary is that:

1. the piezoelectric vibration element temporary stop timing be set so that the inertial force-induced extension which is caused by the interruption of the forced extension can end exactly when the length of the piezoelectric vibration element 14 reaches the natural length L2;
2. the period ΔT of the temporary stop be set to an interval from a timing at which the inertial force-induced extension caused by the interruption of the forced extension of the piezoelectric vibration element starts to a timing at which the length of the piezoelectric vibration element has reached the natural length L2 and the piezoelectric vibration element is thereby about to start contracting; and
3. the length of the piezoelectric vibration element be settled at the natural length L2 with apparently few vibration so that the extension process of the piezoelectric vibration element which is extending from the natural length L2 resumed by discharge cancels out the residual vibration-induced contraction process.

Figure 9A:
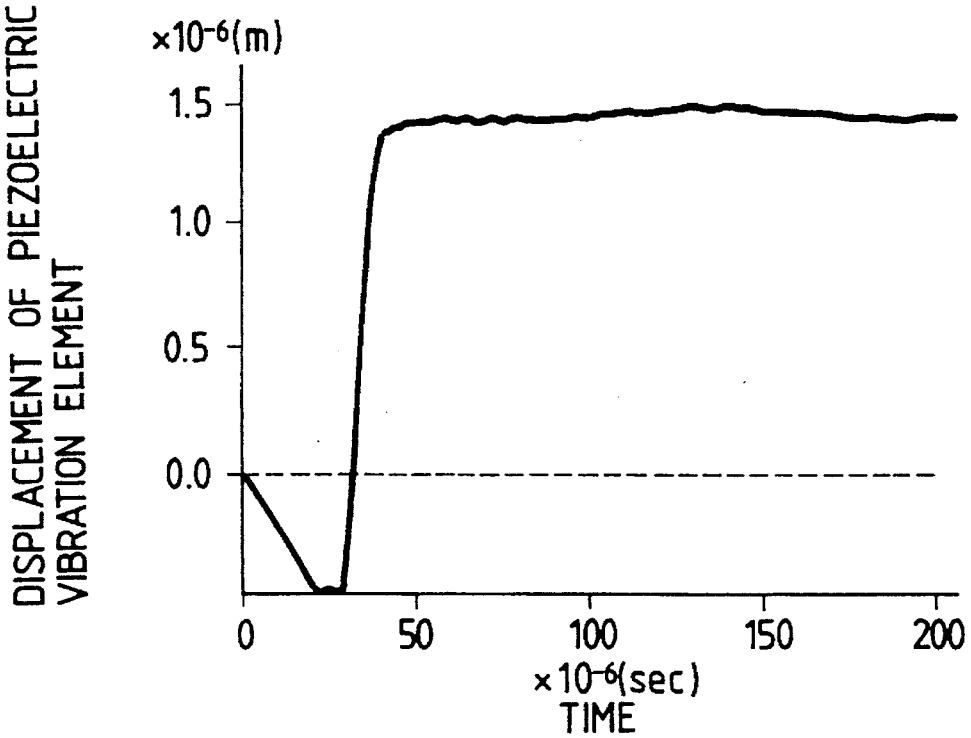
FIGS. 9(*a*) and (*b*) are diagrams respectively showing a displacement of the piezoelectric vibration element controlled by a method of the present invention and conventional one.
Figure 9B:
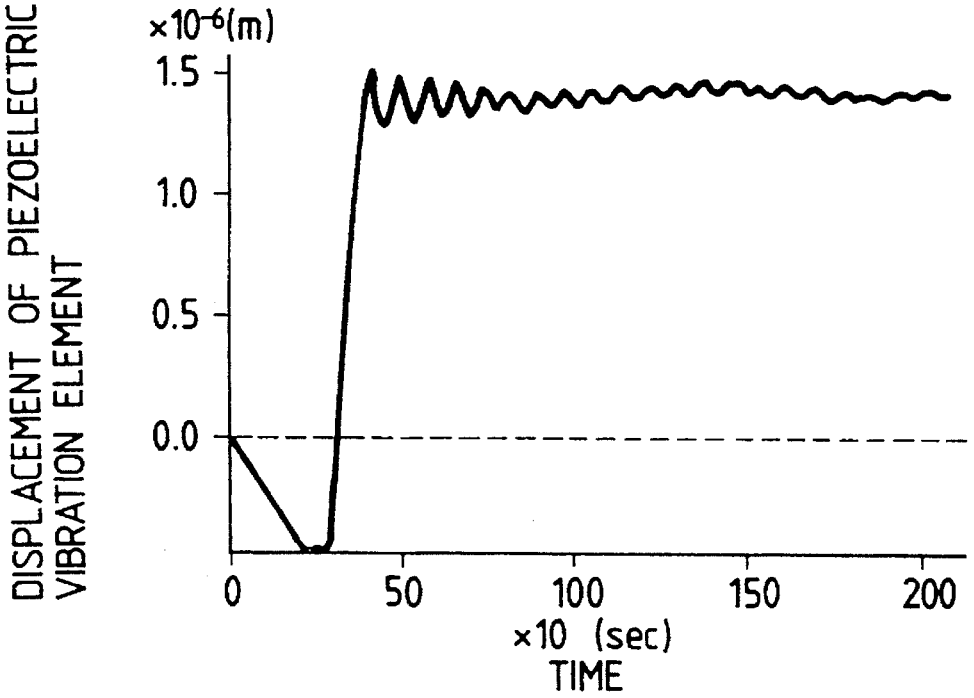
FIG. 9(b) PRIOR ART

FIGS. 9(*a*) and (*b*) show measured displacements at instances of an extension process obtained by driving the thus constructed piezoelectric vibration element under the above-mentioned conditions. FIG. 9 (*a*) shows a case where the piezoelectric vibration element is driven by the drive method shown in FIG. 8; FIG. 9 (*b*) shows a case where the piezoelectric vibration element is driven by the conventional drive method. It is apparent from these measurements that the drive method of the invention can produce necessary ink droplets with few residual vibration. The actual waveform of the vibration with respect to the voltage waveform may be observed, in some cases, as not decaying before the discharge is completed after the temporary stop.

Figure 10A:
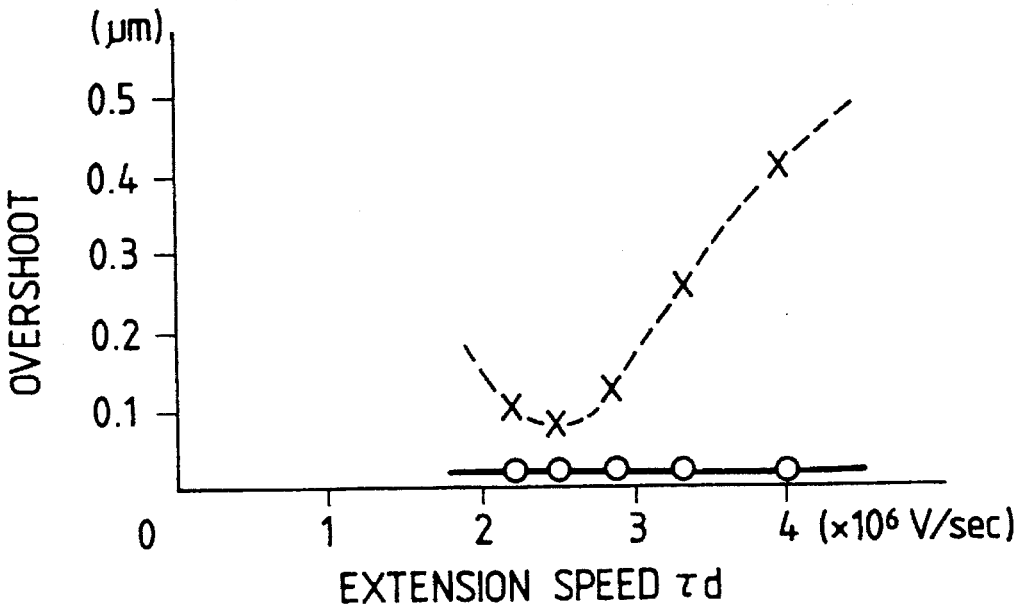
FIGS. 10(*a*) and (*b*) are diagrams respectively showing the overshoot and jetting speed of the piezoelectric vibration element in function of the extension speed of the piezoelectric vibration element in the method of the present invention and in the conventional method, respectively.
Figure 10B:
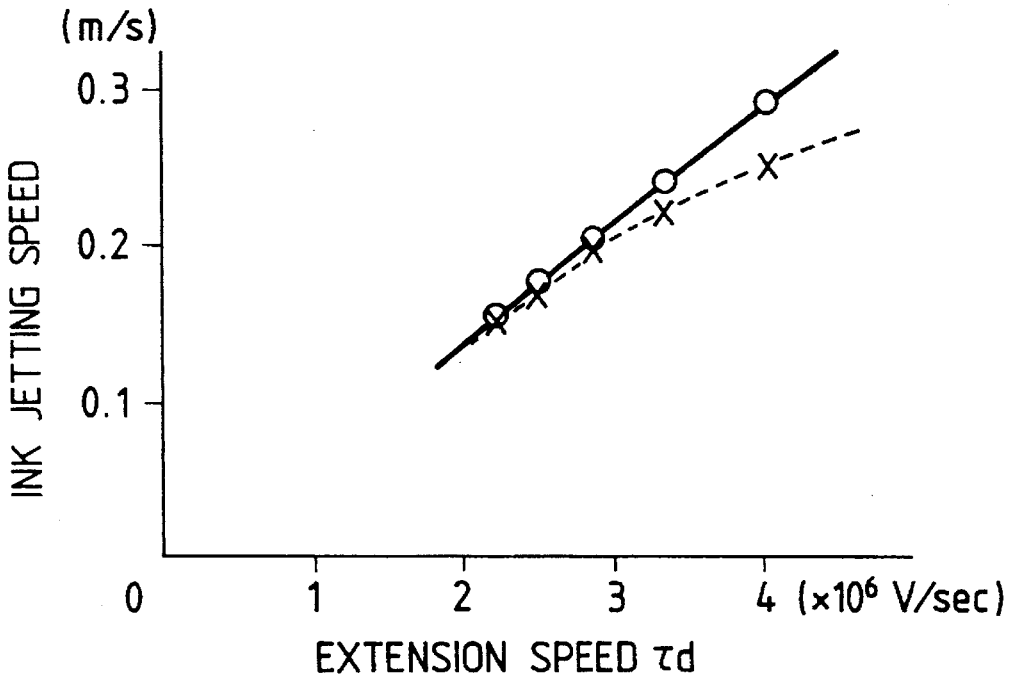

FIGS. 10 (*a*) and (*b*) show the overshoot and ink jetting speed of the piezoelectric vibration element in function of the extension speed (τd) of the piezoelectric vibration element in the method of the invention and in the conventional method, respectively. The measurements were made after an ink droplet had already been jetted. The solid line indicates the measurements by the drive method of the invention, whereas the dotted line indicates the measurements by the conventional drive method. As is apparent from the two diagrams, the drive method of the invention can not only control the overshoot independently of the extension speed τd (FIG. 10 (*a*)), but also linearly change the ink jetting speed by adjusting the extension speed τd (FIG. 10 (*b*)).

In contrast thereto, in the conventional method, not only the overshoot is suddenly increased as the extension speed τd of the piezoelectric vibration element is increased as described above, but also the extension speed contributes less to the ink jetting speed.

Figure 11:
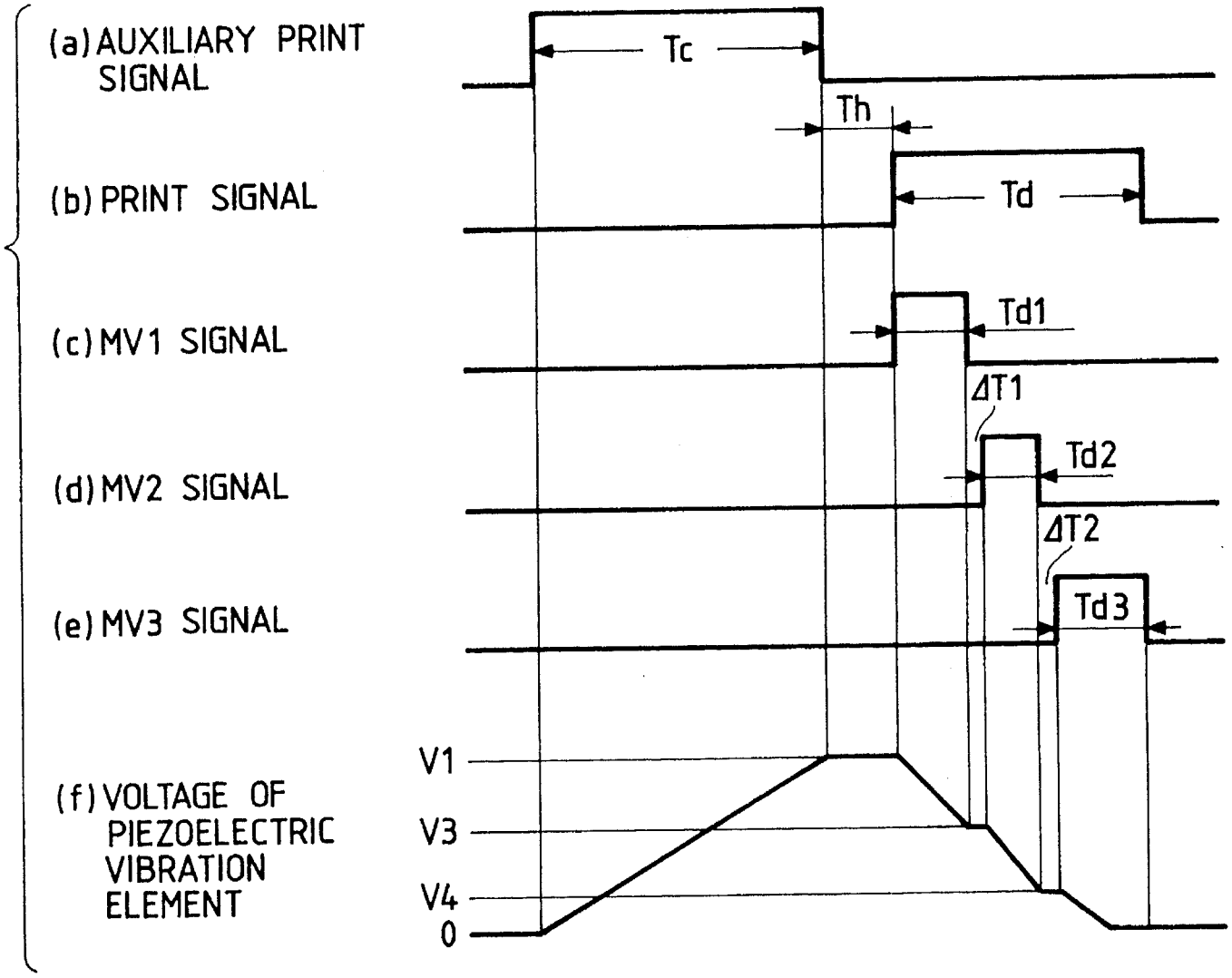
FIG. 11 is a waveform diagram showing another operation of the drive circuit.

While the piezoelectric vibration element extension process is divided into two stages in the above embodiment, it is apparent that the same effect can be obtained by dividing the print signal Td into three segments Td1, Td2, Td3 by two stops ΔT1, ΔT2 and extending the piezoelectric vibration element 14 by these signal segments in three stages (FIG. 11 (*f*)) while temporarily holding the terminal voltage at V3, V4 as shown in FIG. 11.

Figure 12:
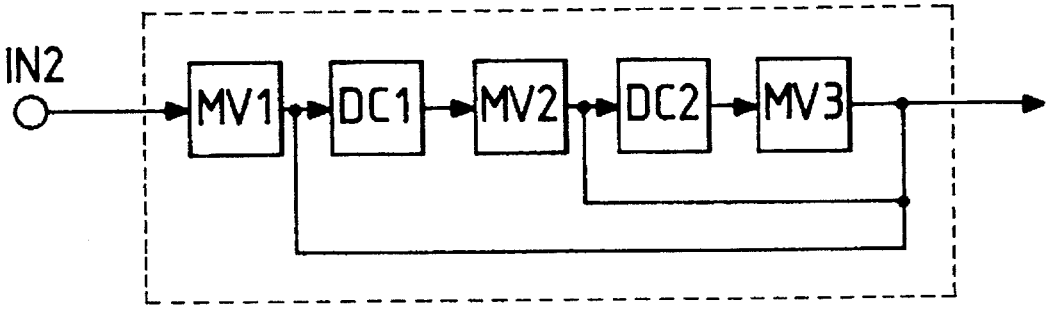
FIG. 12 is a block diagram showing an control unit for generating the drive waveforms.

That is, as shown in FIG. 12, an extension control circuit 45 may be designed to include first, second, and third one-shot multi-vibrators MV1, MV2, MV3 and first and second delay circuits DC1, DC2. The pulse width of each of the one-shot multi-vibrators MV1, MV2, MV3 and the delay period of each of the delay circuits DC1, DC2 may be set to Td1, Td2, Td3, and ΔT1, ΔT2, respectively.

Figure 13:
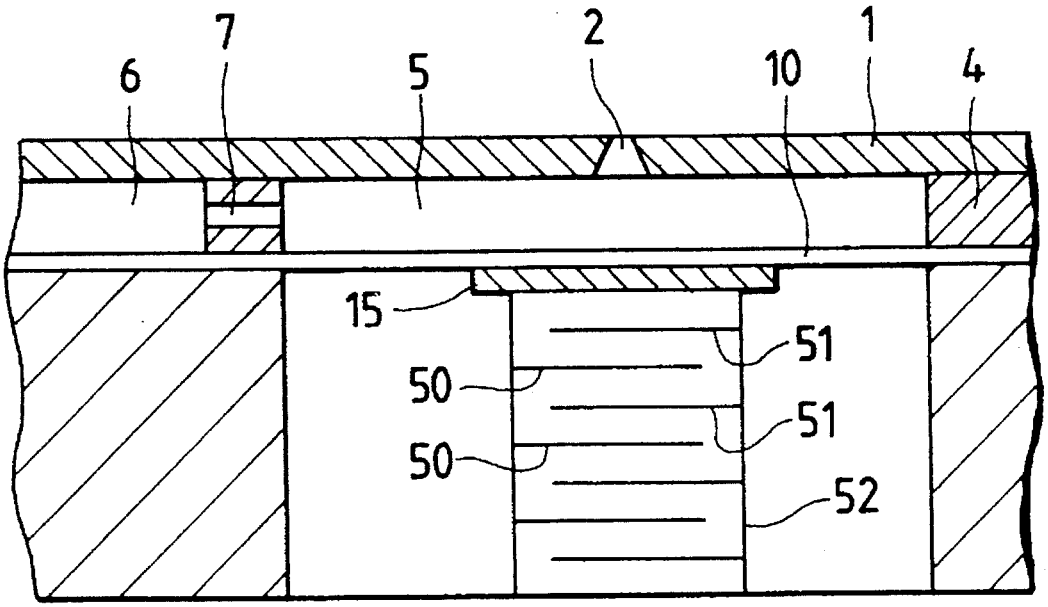
FIG. 13 is a sectional view showing another ink jet recording head according to the invention.

While the example in which the piezoelectric vibration element uses the so-called d31 mode in which the piezoelectric vibration element is contracted by charge and extended by discharge has been described in the above embodiment, it is apparent that similar effects can be obtained by applying the invention to another piezoelectric vibration element 52 using the so-called d33 mode in which electrodes 50 and 51 are arranged vertically with respect to the extension/contraction axis as shown in FIG. 13 so that the piezoelectric vibration element is extended by charge and contracted by discharge. That is, the similar effects can be obtained by charging the piezoelectric vibration element 52 with a print signal on the contrary to the above embodiment, and at this time, by causing the extension control circuit to divide the print signal into a plurality of segments with stops.

Figures 14, 15:
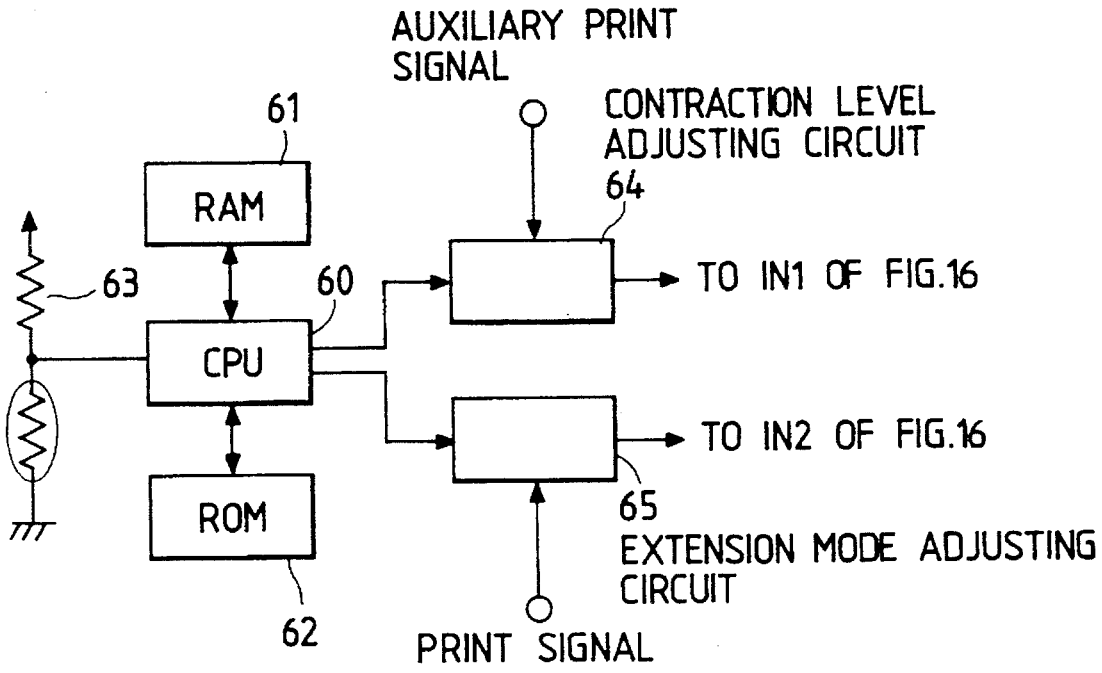
FIG. 14 is a block diagram showing still another embodiment of the invention.
FIG. 15 is a diagram schematically showing data stored in a ROM of the embodiment shown in FIG. 14.

FIG. 14 shows another embodiment of the invention. In FIG. 14, reference numerals 60, 61, 62 respectively designate a CPU, a RAM, and a ROM and of a microcomputer. These components are programmed so that data such as extension period and contraction period of the piezoelectric vibration element can be outputted. Such data serve to maintain the ink jetting characteristic constant based on a signal from a temperature sensor 63 that measures the temperature of the recording head.

As shown in FIG. 15, the ROM 62 stores a plurality of values B1, B2 .... Bn as a charge period Tc and values C1, C2 . . . Cn as a discharge period Td for maintaining the ink jetting characteristic at a predetermined level based on temperature signals A1, A2 . . . An from the temperature sensor 63 that measures the temperature around the recording head.

Figure 16:
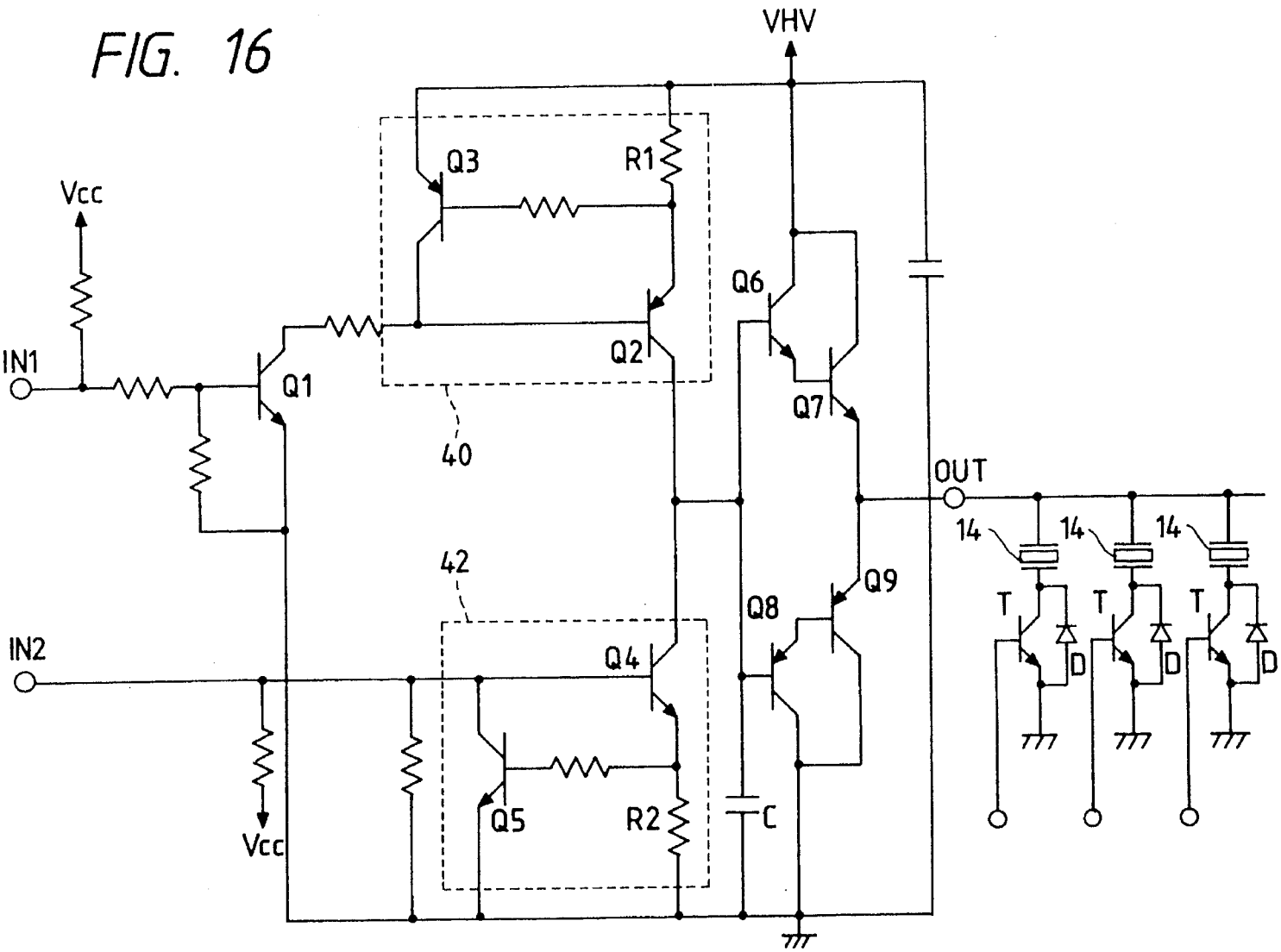
FIG. 16 is a circuit diagram showing a drive circuit according to the embodiment shown in FIG. 14.

Reference numeral 64 designates a contraction level adjusting circuit, which applies a duration of the auxiliary print signal received from a host to a terminal IN1 of a drive circuit shown in FIG. 16 so as to correspond to the discharge period B1, B2 . . . Bn outputted from the CPU 60.

Reference numeral 65 designates an extension mode adjusting circuit, which applies a duration of a print signal from the host to a terminal IN2 of FIG. 16 so as to correspond to the discharge period C1, C2 . . . Cn outputted from the CPU 60. Such circuit can be constructed with ease by combining one-shot multi-vibrators and delay circuits, like the extension control circuit 41 shown in FIG. 5.

FIG. 16 shows the above-mentioned drive circuit, from which the extension control circuit 41 shown in FIG. 5 is excluded. This circuit is designed so that the charge time of the capacitor C and the discharge mode can be controlled directly by the signals inputted to the terminals IN1, IN2.

According to the thus constructed circuit, the temperature of the recording head is detected by the temperature sensor 63; an optimal charge period Tc that can maintain the irk droplet forming characteristic such as the ink jetting speed of the recording head at a reference value is selected from among the data B1, B2 . . . Bn, e.g., data B2 is selected, and such a discharge period Td as not to cause residual vibration with respect to the charge period B2, i.e., data C2 is selected; and the selected data, e.g., B2 and C2, are applied to the contraction level adjusting circuit 64.

Accordingly, the piezoelectric vibration elements 14 are charged by the selected charge period B2. Therefore, the final charge voltage is defined by the data B2, and the piezoelectric vibration element undergoes contraction commensurate with such final voltage.

On the other hand, a discharge period and a stop period ΔT by the discharge data C2 outputted from the CPU 60 are set at the extension mode adjusting circuit 65. Upon input of the print signal under this condition, the capacitor C is discharged by the signal from the extension mode adjusting circuit 65. As a result, residual vibration caused by the release of resilient energy resulting from the contraction level defined by the discharge period B2 can be controlled to a smallest possible value, which in turn allows change in the recording head characteristic due to change in temperature to be corrected without inducing satellite.

Figure 17A:
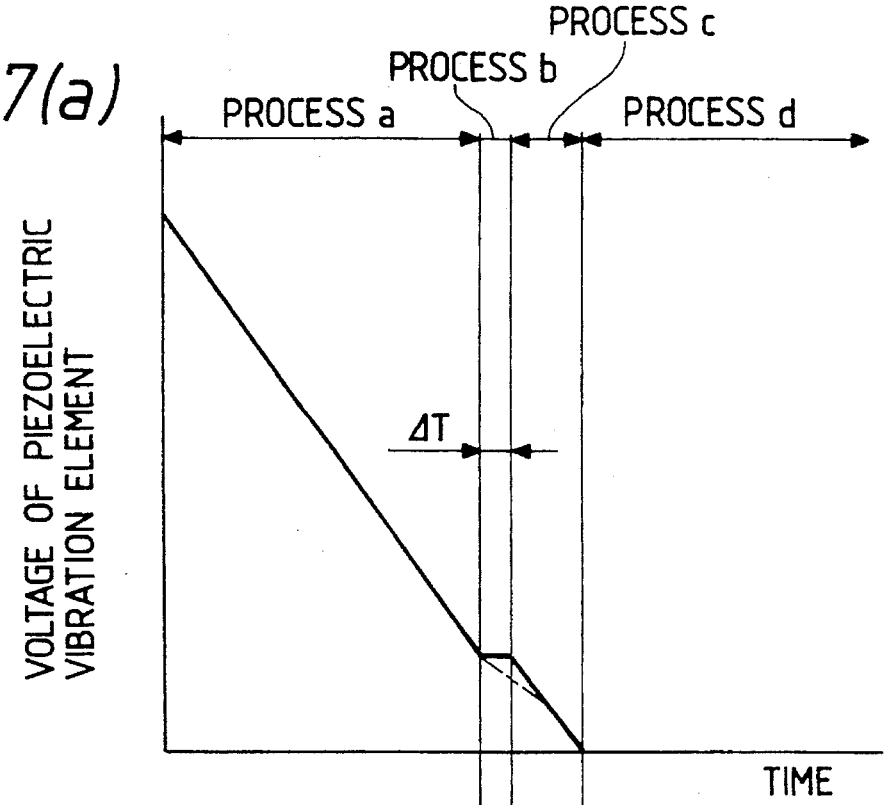
FIG. 17(*a*) and (*b*) are diagrams showing still another embodiment of the invention.
Figure 17B:
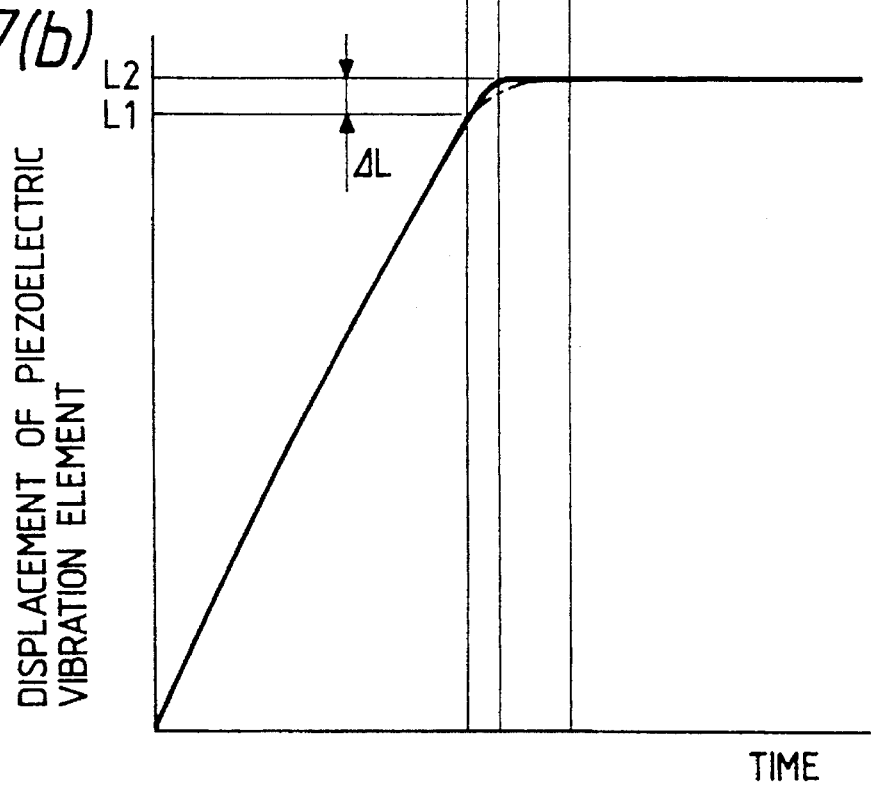

While the case of temporarily holding the voltage has been described in this embodiment, a method of controlling the charge and discharge in the following manner may also be applicable. That is, the piezoelectric vibration element is discharged at a speed lower than that of the first stage and at a high speed again at the last stage as indicated by a one dot chain line shown in FIGS. 17(*a*) and (*b*) instead of the temporary stop. In this case, the curve depicting displacement of the piezoelectric vibration element is such as shown by a one dot chain line in FIG. 17(*b*).

Figure 18A:
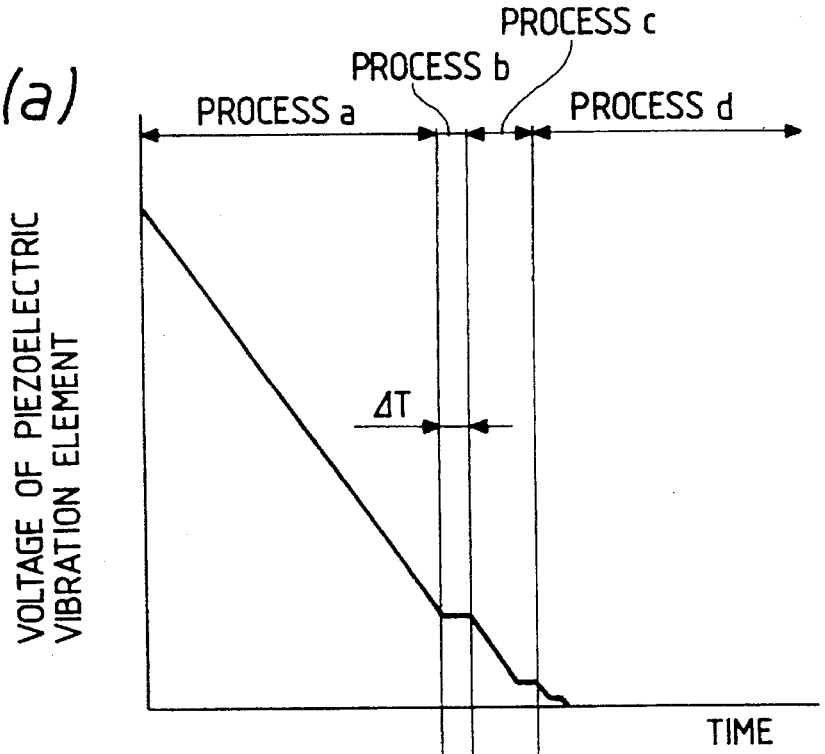
FIGS. 18(*a*) and (*b*) are diagrams showing still another embodiment of the invention.
Figure 18B:
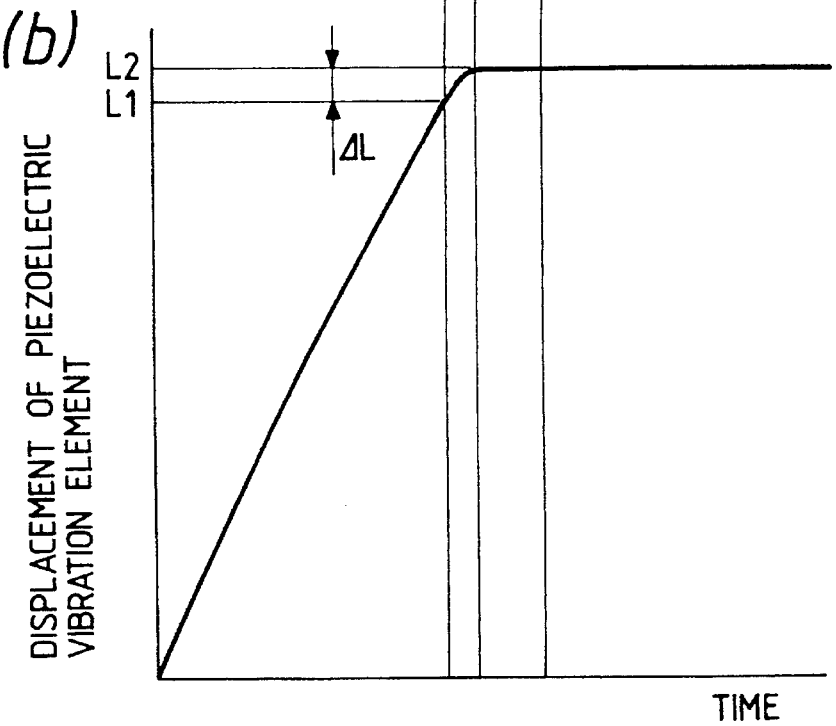

While the voltage is temporarily held only once in this embodiment, the voltage may be temporarily held for more than one time as shown in FIGS. 18(*a*) and (*b*).

While the system in which the piezoelectric vibration element is extended by discharge has been described in the above embodiments, it goes without saying that the same effect can be obtained by a system in which the piezoelectric vibration element is extended by charge.

As described in the foregoing, the invention includes: an ink jet recording head that sucks an ink into a pressure chamber formed of a nozzle plate and a vibration plate and jets an ink droplet from a nozzle opening by expanding and contracting the pressure chamber by a piezoelectric vibration; and a signal generating means that generates a first signal for contracting the piezoelectric vibration element at a predetermined speed to allow the pressure chamber to suck the ink; a second signal for extending the piezoelectric vibration element to splash the ink droplet from the nozzle opening by contracting the pressure chamber; a third signal for interrupting the extension process at least once; and a fourth signal for causing the piezoelectric vibration element to resume the extension process after a predetermined time has elapsed. Therefore, the residual vibration of the piezoelectric vibration element after the ink droplet jetting operation can be made as small as possible, which then contributes to improving the print quality in addition to increasing the print speed.

What is claimed is:

1. An ink jet recording apparatus comprising:

an ink jet recording head for sucking an ink into a pressure chamber and jetting an ink droplet from a nozzle opening by expanding and contracting the pressure chamber by a piezoelectric vibration element, said pressure chamber being at least partially defined by a nozzle plate in which the nozzle opening is formed and a vibration plate which contacts the vibration element; and a signal generating means for generating signals to be applied to the piezoelectric vibration element, said signals comprising, a first signal for contracting the piezoelectric vibration element at a predetermined speed to suck the ink into the pressure chamber, a second signal for starting an extension process of the piezoelectric vibration element to splash the ink droplet from the nozzle opening by contracting the pressure chamber, a third signal for interrupting the extension process of the piezoelectric vibration element at least once while the extension process is still being performed, and a fourth signal for resuming the extension process of the piezoelectric vibration element again after a predetermined period has elapsed.

2. An ink jet recording apparatus according to claim 1, wherein the piezoelectric vibration element is designed to operate in a d31 mode in which the piezoelectric vibration element is contracted by charge and extended by discharge; and the signal generating means includes a first constant current circuit for supplying a predetermined current to a capacitor, a second constant current circuit for discharging the capacitor by a predetermined current, and an extension control circuit for controlling an operation timing and a discharge current of the second constant current circuit in two stages, said two stages being divided by at least one interruption.

3. An ink jet recording apparatus according to claim 1, wherein the piezoelectric vibration element is designed to operate in a d33 mode in which the piezoelectric vibration element is contracted by discharge and extended by charge; and the signal generating means includes a first constant current circuit for supplying a predetermined current to a capacitor, a second constant current circuit for discharging the capacitor by a predetermined current, and an extension control circuit for controlling an operation timing and a discharge current of the second constant current circuit in two stages, said two stages being divided by at least one interruption.

4. An ink jet recording apparatus according to claim 1, wherein said extension process of the piezoelectric vibration element after said interruption is resumed at a timing when the displacement of said residual vibration caused by said interruption turns from the extension owing to an overshoot to the contraction.

5. An ink jet recording apparatus according to claim 1, further comprising a means for modifying the first signal and the second signal by a temperature of the recording head.

6. An ink jet recording apparatus according to claim 1, further comprising:

a temporary stopping means for exactly generating the third signal at such a timing that the length of the piezoelectric vibration element reaches a natural length by an inertial force caused by a forced extension of the piezoelectric vibration element being interrupted while the forced extension is still being performed, the third signal serving to interrupt the extension process of the piezoelectric vibration element at least once; and an extension process resuming signal generating means for generating the fourth signal at such a timing that an inertial force-induced extension caused by the forced extension of the piezoelectric vibration element being interrupted while the forced extension is still being performed is started, the length of the piezoelectric vibration element reaches the natural length, and the piezoelectric vibration element is thereby about to start contracting, the fourth signal serving to resume the extension of the piezoelectric vibration element.

7. A method of controlling an ink jet recording apparatus, said ink jet recording apparatus including an ink jet recording head comprising at least one pressure chamber having a nozzle opening and at least one piezoelectric vibration element which abuts the pressure chamber, wherein an ink is sucked into said pressure chamber by expanding said pressure chamber according to a contraction of said piezoelectric vibration element and an ink droplet is jetted from the nozzle opening by contracting the pressure chamber according to an extension of said piezoelectric vibration element, said method including a step of eliminating residual vibration of the piezoelectric vibration element when the ink droplet is jetted from the nozzle opening by temporarily stopping charge or discharge of a capacitor in order to control a forced contraction and extension of the piezoelectric vibration element, said step of eliminating the residual vibration comprising the steps of:

setting a temporary stop to be made during the extension process of the piezoelectric vibration element to such an extension speed and timing as to exactly end inertial force-induced extension where a length of the piezoelectric vibration element has reached a natural length, the inertial force-induced extension being caused by interrupting a forced extension while the forced extension is still being performed;

then setting the temporary stop to an interval from a timing at which the inertial force-induced extension is started to a timing at which the length of the piezoelectric vibration element has reached the natural length and the piezoelectric vibration element is thereby about to start contracting; and then setting the extension process resumption to such an extension speed and timing as to allow the piezoelectric vibration element to restore the natural length with apparently few vibration by causing the resumed extension process of the piezoelectric vibration element extending from the natural length to cancel out contraction attributable to residual vibration.

8. A method of controlling an ink jet recording apparatus, said ink jet recording apparatus including an ink jet recording head comprising at least one pressure chamber having a nozzle opening and at least one piezoelectric vibration element which abuts the pressure chamber, wherein an ink is sucked into said pressure chamber by expanding said pressure chamber according to a contraction of said piezoelectric vibration element and an ink droplet is jetted from the nozzle opening by contracting the pressure chamber according to an extension of said piezoelectric vibration element, said method including a step of eliminating residual vibration of the piezoelectric vibration element when the ink droplet is jetted from the nozzle opening by temporarily stopping charge or discharge of a capacitor in order to control a forced contraction and extension of the piezoelectric vibration element, said step of eliminating the residual vibration comprising steps of:

setting a period from a start of extending said piezoelectric vibration element to a temporary stop to about a single characteristic vibration period;

setting a period for temporarily holding a voltage to about a quarter of the single characteristic vibration period; and setting a period between a temporary voltage holding end and a charge or discharge end to about a quarter of the single characteristic vibration period.

9. A method of controlling an ink jet recording apparatus, said ink jet recording apparatus including an ink jet recording head comprising at least one pressure chamber having a nozzle opening and at least one piezoelectric vibration element which abuts the pressure chamber, wherein an ink is sucked into said pressure chamber by expanding said pressure chamber according to a contraction of said piezoelectric vibration element and an ink droplet is jetted from the nozzle opening by contracting the pressure chamber according to an extension of said piezoelectric vibration element, said method including a step of eliminating residual vibration of the piezoelectric vibration element when the ink droplet is jetted from the nozzle opening by temporarily stopping charge or discharge of a capacitor in order to control a forced contraction and extension of the piezoelectric vibration element, said step of eliminating the residual vibration further comprising a step of:

setting at least a period for temporarily holding a voltage to about a quarter of a single characteristic vibration period.

10. An ink jet recording apparatus, including an ink jet recording head comprising at least one pressure chamber having a nozzle opening and at least one piezoelectric vibration element which abuts the pressure chamber, wherein an ink is sucked into said pressure chamber by expanding said pressure chamber according to a contraction of said piezoelectric vibration element and an ink droplet is jetted from the nozzle opening by contracting the pressure chamber according to an extension of said piezoelectric vibration element, said ink jet recording apparatus further comprising:

eliminating means for eliminating residual vibration of the piezoelectric vibration element when the ink droplet is jetted from the nozzle opening by temporarily stopping charge or discharge of a capacitor in order to control a forced contraction and extension of the piezoelectric vibration element, and setting means for setting the temporary stop to about a quarter of a single characteristic vibration period.

* * * * *